US009085059B2

(12) United States Patent
Tschudin et al.

(10) Patent No.: US 9,085,059 B2
(45) Date of Patent: Jul. 21, 2015

(54) CENTERLESS CYLINDRICAL GRINDING MACHINE AND CENTERLESS GRINDING METHOD WITH HEIGHT-ADJUSTABLE REGULATING WHEEL

(75) Inventors: Urs Tschudin, Grenchen (CH); Libor Sedlacek, Grenchen (CH)

(73) Assignee: Urs Tschudin, Grenchen (CH)

( * ) Notice: Subject to any disclaimer, the term of this patent is extended or adjusted under 35 U.S.C. 154(b) by 1022 days.

(21) Appl. No.: 13/156,785

(22) Filed: Jun. 9, 2011

(65) Prior Publication Data

US 2011/0306273 A1 Dec. 15, 2011

(30) Foreign Application Priority Data

Jun. 14, 2010 (EP) ..... 10405115

(51) Int. Cl.

| | |
|---|---|
| ***B24B 51/00*** | (2006.01) |
| ***B24B 5/22*** | (2006.01) |
| ***B24B 5/30*** | (2006.01) |
| ***B24B 5/307*** | (2006.01) |

(52) U.S. Cl.

CPC ... *B24B 5/22* (2013.01); *B24B 5/30* (2013.01); *B24B 5/307* (2013.01)

(58) Field of Classification Search

CPC ..... B24B 51/00; B24B 5/18; B24B 5/22; B24B 5/30

USPC ..... 451/259, 242, 5, 49

See application file for complete search history.

(56) References Cited

U.S. PATENT DOCUMENTS

| | | | | | |
|---|---|---|---|---|---|
| 1,722,386 | A | * | 7/1929 | Norton | 451/242 |
| 2,020,541 | A | * | 11/1935 | Ernst | 451/242 |
| 4,062,150 | A | * | 12/1977 | Masuda et al. | 451/49 |
| 4,083,151 | A | * | 4/1978 | Jessup et al. | 451/242 |
| 4,570,387 | A | | 2/1986 | Unno | |
| 4,783,932 | A | * | 11/1988 | Sager | 451/242 |

FOREIGN PATENT DOCUMENTS

JP 2003 191153 7/2003

OTHER PUBLICATIONS

European Search Report dated Oct. 14, 2010.

* cited by examiner

*Primary Examiner* — Robert Rose

(74) *Attorney, Agent, or Firm* — Venable LLP; Jeffri A. Kaminski; Trent B. Ostler

(57) ABSTRACT

The present invention pertains to a centerless cylindrical grinding machine with a grinding wheel and a regulating wheel that can be laterally displaced toward a work piece that can be held between these wheels, and with a rest blade for supporting the work piece that is realized rigid in the vertical direction and arranged and dimensioned such that a rotational axis of the work piece and a rotational axis of the grinding wheel lie in a common plane, wherein a height adjustment of the rotational axis of the regulating wheel beyond the plane is kinematically decoupled from the lateral displacement of the regulating wheel and can be varied in order to position the regulating wheel on the supported work piece.

6 Claims, 3 Drawing Sheets

CENTERLESS CYLINDRICAL GRINDING MACHINE AND CENTERLESS GRINDING METHOD WITH HEIGHT-ADJUSTABLE REGULATING WHEEL

FIELD OF THE INVENTION

The invention pertains to the technical field of production engineering and, in particular, a centerless grinding machine, an arrangement of a work piece for centerless grinding and a corresponding method.

BACKGROUND OF THE INVENTION

In centerless grinding, it is common practice to grind above or below the centers of the grinding wheel and the regulating wheel. The tangential angle, at which the work piece contacts the grinding wheel and the regulating wheel, typically lies between 6 and 11 degrees.

This is achieved by adjusting the height of the rest blade. This height adjustment is realized, for example, with a wedge, a cam shaft or a motor-adjustable axle.

In addition, the diamond for truing the regulating wheel needs to be moved to the center height, i.e., the height of the rotational axis of the work piece, in order to realize a straight surface line at the contact height of the work piece with the regulating wheel. For this purpose, the diamond height of the regulating wheel initially needs to be realized in an adjustable fashion. However, an exact adjustment is still difficult because the truing needs to be carried out in an offset fashion referred to the circumference.

In angular infeed grinding, in which the rotational axis of the grinding wheel is not parallel to the rest blade and the rotational axis of the regulating wheel, the blade needs to be inclined in order to prevent or minimize distortions on a shoulder of the work piece.

Regardless of the grinding infeed, the adjustment of the blade height is always tedious. In addition, different heights need to be tested beforehand in order to achieve an optimal circularity. Furthermore, the height needs to be readjusted as the grinding wheel wears down. However, since the region between the grinding wheel and the regulating wheel only provides limited space, height adjustment systems cannot be realized as massively as it would be required for supporting a work piece. When grinding outside the center height of the grinding wheel, profile distortions therefore occur on its shoulders in angular infeed grinding.

SUMMARY OF THE INVENTION

Embodiments of the present invention eliminate these disadvantages and to make available a centerless cylindrical grinding machine that allows a simple, fast and accurate manipulation of the grinding adjustments and consequently the reliable production of high-quality ground sections, wherein said grinding machine furthermore has a simple design and can be cost-efficiently manufactured.

In stark contrast to any prior art known so far, one important aspect of the cylindrical grinding machine is that the centers of the grinding wheel and of the work piece now lie in one plane and an adjustment of the rest blade is exclusively realized in the form of a height adjustment of the regulating wheel—that is decoupled from all other motions. In the following description, the respective center of the grinding wheel and the regulating wheel, as well as of the work piece, refers to the point formed by the respective rotational axis in the viewing direction thereof.

This provides a number of advantages, particularly that a stable axis can be realized for the height adjustment of the regulating wheel. Consequently, the center height of the work piece can be very accurately adjusted by displacing the infeed carriage of the regulating wheel. This can be used for always grinding at the optimal height, particularly when the work piece is significantly ground down such that its diameter changes. In addition, the diamond or the rotative truing tool for the regulating wheel can be mounted at a fixed height because the regulating wheel can be displaced to the correct height. In this case, the height of its rotational axis may lie above or below the common plane. Since all adjustments are realized with only one axis, namely by positioning the rotational axis of the regulating wheel accordingly, the machine can also be designed in a particularly simple fashion.

In one advantageous embodiment, it is proposed that the rotational axes of the grinding wheel and the regulating wheel are not aligned axially parallel to one another and, in particular, set up for angular infeed grinding. The necessity of an angular position of the axes on the one hand results from the work piece profile that requires, e.g., an angular infeed. On the other hand, it also results from the type of grinding process such as, e.g., through-feed grinding with an axis that is inclined relative to the other axis such that a slope is formed. In both instances, increased profile distortions may occur that are essentially caused by the grinding wheel and/or regulating wheel wearing down and/or the work piece being ground down and the associated migration of the work piece from its original position. The height adjustability of the regulating wheel now makes it possible to compensate these profile distortions by adjusting the regulating wheel only such that the advantages of through-feed grinding and angular infeed grinding, e.g., the grinding of large quantities and of complex work piece profiles, can be much better utilized.

In another preferred embodiment, a motor drive is provided for adjusting the regulating wheel. However, it would naturally also be conceivable, in principle, to adjust the regulating wheel manually.

Furthermore, an arithmetic unit is preferably provided for automatically controlling the motor drive. A computer-controlled drive already makes it possible to realize a significant degree of automation, e.g., by utilizing a CNC control (Computer Numeric Control). This reliably precludes inaccuracies of a manual pre-adjustment such that the processing quality of the work pieces is improved.

In the set-up mode, the regulating wheel can be quickly displaced to different heights, e.g., by means of the CNC control, in order to optimize the circularity of the work pieces. In this case, these optimal height adjustments of the regulating wheel preferably can be stored in and retrieved from a storage unit. Since the values are already available at the machine, a particularly fast pre-adjustment of the regulating wheel can be achieved. These height adjustments may also be stored for individual work pieces such that a quick changeover to different work pieces can be realized. This reduces the processing time per work piece such that even different batches can be quickly processed.

A particularly high degree of automation is achieved in that the arithmetic unit is connected to the storage unit in order to retrieve optimal height adjustments of the regulating wheel. This once again significantly reduces the usually required set-up time of the machine because the regulating wheel can automatically retrieve and consequently move to the respectively optimal height adjustment.

The arithmetic unit preferably is furthermore designed for compensating deviations of the rotational axis of the work piece from the common plane with the rotational axis of the grinding wheel by adjusting the regulating wheel. Such a deviation may be caused by the grinding wheel and/or regulating wheel wearing down and/or by the work piece being ground down. This can be compensated in that the arithmetic unit reacts to measured values of a corresponding sensor system that detects a migration of the work piece from its original center position. Optimal height adjustments, to which the regulating wheel can be respectively displaced, are stored in the storage unit for each of these deviations.

The arithmetic unit preferably is also designed for automatically truing the regulating wheel on at least one truing tool such that the truing process can also be carried out automatically and therefore easily, quickly and reliably. This reduces the set-up time of the machine prior to the actual grinding process.

In this respect, it is advantageous if the at least one truing tool is guided in the common plane of the rotational axis of the grinding wheel and the rotational axis of the work piece. This eliminates all adjusting processes in the direction of the height of the tool such that not only the construction of the machine is simplified, but the truing process itself also becomes very simple and reliable. In addition, the tool is easily accessible for maintenance purposes because it is arranged such that it can be moved out of the space between the grinding wheel and the regulating wheel.

Another advantage is attained if the at least one truing tool is controllable and movable in a variable position and/or along additional axes. This simplifies the truing of the grinding wheel and of the regulating wheel to work piece geometries that significantly vary along the rotational axis of the work piece. Consequently, the grinding machine can also be quickly and reliably adjusted to work pieces that are rather difficult to grind.

It is furthermore advantageous if the at least one truing tool features a truing diamond or a truing device for the grinding wheel and/or a truing diamond or a truing tool for the regulating wheel or if the truing tool is designed for being selectively equipped with truing devices of this type. The truing diamond or the truing device may be used as a first truing tool for the grinding wheel and/or as a second truing tool for the regulating wheel.

In another preferred embodiment, the grinding machine furthermore features a coolant supply, by means of which coolant can be supplied to the region, in which the grinding wheel engages with the work piece. Reliable cooling can be ensured in this fashion such that the service life of the grinding wheel and the regulating wheel is extended. Another advantage of this direct cooling can be seen in that a high thermal stability is ensured. For example, an outlet nozzle of the coolant supply can be mounted on a housing of the machine. Since this nozzle is permanently arranged in the grinding gap, its position does not have to be compensated when the diameter of the grinding wheel decreases due to its operation.

It is preferred that the grinding wheel comprises several partial grinding wheels that are successively arranged on the rotational axis of the grinding wheel, and that the regulating wheel comprises several partial regulating wheels that are successively arranged on the rotational axis of the regulating wheel. Consequently, several grinding operations can be carried out at the same time. This reduces the time required for loading and unloading the work piece and for setting up the grinding machine.

In this case, the rest blade is preferably designed in such a way that the work piece can be sequentially displaced along its rotational axis in order to carry out a sequential grinding process. For this purpose, the rest blade is designed rigidly in the vertical direction and displaceably in the horizontal direction. The overall time required for the grinding operation is significantly reduced in this fashion. The loading of the work pieces outside the grinding region, the truing (dressing) of the grinding wheel and the regulating wheel and an oscillation of the work pieces are simultaneously promoted.

The grinding machine is preferably constructed on a machine bed of thermally stable natural granite such that a high mechanical and thermal stability of the grinding machine components is ensured.

The above-described objective is also attained with an arrangement that concerns the basic grinding principle described herein regardless of the grinding machine design. However, this arrangement is preferably provided for grinding processes on a centerless cylindrical grinding machine.

One important aspect of the method can be seen in that it can be carried out very easily. The grinding process surprisingly can—in contrast to previous assumptions—be controlled by means of a kinematically decoupled adjustment of the regulating wheel only if the centers of the grinding wheel and the work piece lie at the same height, i.e., if their rotational axes form one plane. This allows a particularly efficient and effective process control that furthermore can be implemented in a constructively simple fashion.

As already described above in connection with the cylindrical grinding machine, it is advantageous if optimal height adjustments of the rotational axis of the regulating wheel are stored and retrieved. Consequently, the corresponding values are quickly available such that a fast pre-adjustment of the regulating wheel can be achieved. It is furthermore possible to store optimal height adjustments for different work pieces such that a fast change of the adjustments for grinding different work piece batches can be realized.

A significant simplification, acceleration and quality improvement of the grinding process are achieved in that a deviation of the rotational axis of the work piece from the common plane with the rotational axis of the grinding wheel is compensated by automatically adjusting the regulating wheel. For this purpose, the wearing-down of the grinding wheel and/or regulating wheel and/or the grinding-down of the work piece can be monitored and a corresponding optimal height adjustment of the regulating wheel, to which the regulating wheel needs to be displaced in order to compensate the deviation of the work piece, is calculated or retrieved. In this case, the wearing-down or the grinding-down can be derived from a change in the angle between the center of the regulating wheel and the center of the grinding wheel on the one hand and between the center of the regulating wheel and the center of the work piece on the other hand.

If the truing tool is guided in the common plane of the rotational axis of the grinding wheel and the rotational axis of the regulating wheel, the effects of errors that may be caused by a height-adjustable tool are eliminated. The truing tool can be rigidly supported in the vertical direction. Since this means that only the regulating wheel needs to be adjusted for the truing process, this process can be carried out with correspondingly higher accuracy and reliability.

DESCRIPTION OF THE DRAWINGS

Exemplary embodiments of the invention are described in detail below with reference to the attached figures. Identical or identically acting components are identified by the same reference symbols. In these figures.

DETAILED DESCRIPTION

Figure 1:
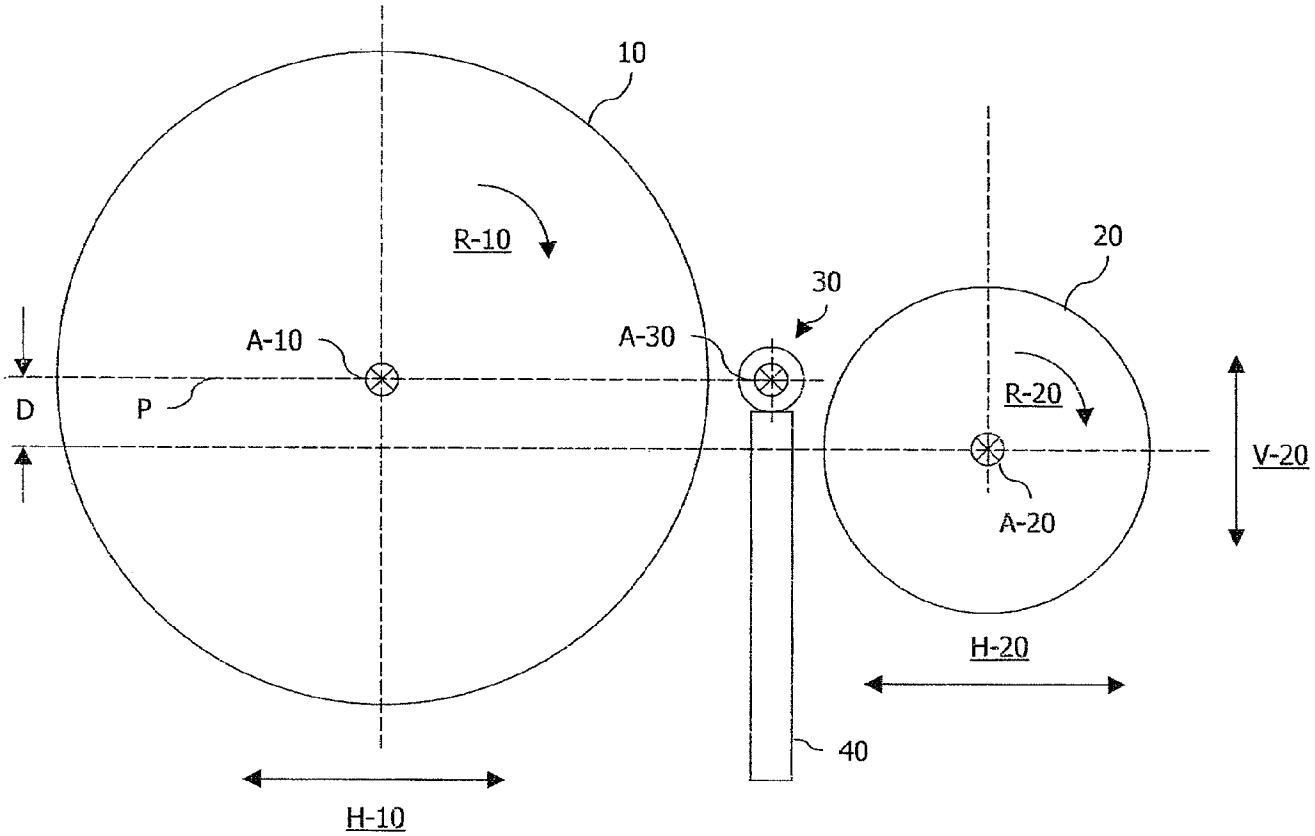
FIG. 1 shows a perspective top view of an arrangement of a grinding wheel, a regulating wheel and a work piece.

FIG. 1 shows a schematic representation of the arrangement of a grinding wheel 10, a regulating wheel 20 and a work piece 30. The work piece 30 lies on a rest blade 40 that is dimensioned in accordance with the size of the work piece 30 and arranged such that a center of the work piece 30, i.e., its rotational axis A-30 (Axis-30), lies in a common plane P (Plane) with the center of the grinding wheel 10, i.e., its rotational axis A-10. In order to grind the work piece 30, the grinding wheel 10 and the regulating wheel 20 can be displaced toward the work piece 30 along the directions H-10 (Horizontal-10) and H-20 and away from the work piece once the grinding process is completed. The wheels 10 and 20 rotate in the indicated directions R-10 and R-20 during the grinding process. A center or a rotational axis A-20 of the regulating wheel 20 is realized with an inventive height adjustment D (Displacement) relative to the plane P, wherein the rotational axis of the regulating wheel is vertically displaced relative to the plane P by this height adjustment. In the figure, the rotational axis A-20 of the regulating wheel 20 is downwardly displaced relative to the plane P by the height adjustment D. However, the rotational axis A-20 may also be upwardly displaced relative to the plane P by the height adjustment D.

For this purpose, the regulating wheel 20 can be displaced in the directions V-20, namely such that it is decoupled from the motions along the directions H-20. This means that the height of the grinding wheel 10 and of the work piece 30 is invariable and that all adjustments required for the grinding process are realized with the regulating wheel 20 only. These include the initial displacement for achieving a desired optimal contact surface with the work piece 30, wherein this displacement can be realized automatically, e.g., with the aid of a (not-shown) CNC-controlled motor drive. Its control may feature a storage unit, in which optimal height adjustments D for the specific work piece 30 to be ground are stored and can be retrieved by an operator. The storage unit may also contain height adjustments D to be realized in dependence on the amount, by which the grinding wheel 10 and/or the regulating wheel 20 wears down and/or the work piece 30 is ground down. It is also possible to take into account other process variables such as, e.g., the rotational speed and/or the type of the two wheels 10 and 20, the throughput speed of the work piece 30, the type of grinding oil, the ambient temperature, etc. This may be simply realized by providing a sensor system that detects a migration of the work piece 30 from its position based on a change in the angle between the center A-20 of the regulating wheel 20 and the center A-10 of the grinding wheel 10. Since only the height of the regulating wheel 20 can be adjusted, the inventive arrangement can be constructively realized in a particularly simple fashion, especially in light of the fact that sufficient space for arranging a correspondingly stable vertical guide including motor drive is available in the region of the regulating wheel 20. Furthermore, all process-relevant adjustments and readjustments can be realized with the regulating wheel 20 only such that the control of the grinding process is significantly simplified. This control can also be used for displacing the regulating wheel 20 toward a (not-shown) truing tool that is ideally situated in the plane P between the wheels 10 and 20. All in all, the arrangement therefore allows a particularly simple design of a corresponding grinding machine that furthermore has a higher degree of automation such that the processing of the work pieces is carried out in a significantly easier, faster and more accurate fashion.

Figure 2:
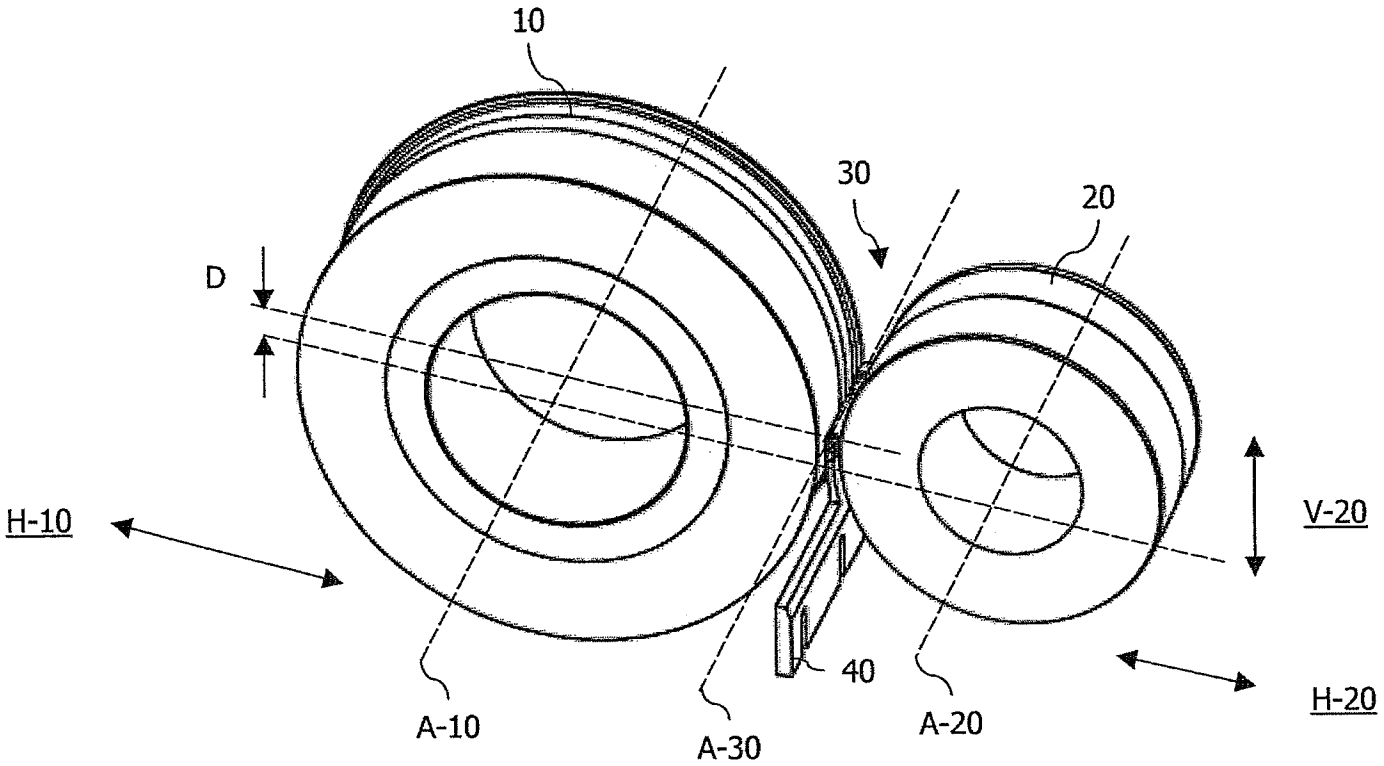
FIG. 2 shows a perspective top view of a first arrangement of a grinding wheel, a regulating wheel and a work piece for straight infeed grinding.

FIG. 2 shows a perspective top view of a first arrangement of a grinding wheel 10, a regulating wheel 20 and a work piece 30 for straight infeed grinding, wherein this arrangement features the same functional elements as in FIG. 1. FIG. 2 primarily serves for elucidating spatial aspects of the arrangement. For example, this figure shows that the work piece 30 has different diameters. In this case, the work piece 30 can only migrate from a desired center position when the grinding wheel 10 and/or the regulating wheel 20 wears down and/or the work piece 30 is ground down. Profile distortions are usually not expected in this arrangement. In through-feed grinding, for example, the rotational axis A-20 of the regulating wheel would, in contrast, be slightly inclined in order to form a slope, along which the work piece 30 moves between the wheels 10, 20. At a non-optimal height adjustment of the regulating wheel 20, profile distortions would occur over the entire circumference of the work piece 30. According to the invention, an optimal surface contact between the regulating wheel 20 and the work piece 30 can be achieved by displacing the regulating wheel 20 beyond the plane P (see FIG. 1) by a height adjustment D, namely along the directions V-20. Consequently, an optimal circularity of the work piece can be achieved by adjusting the regulating wheel 20 only, wherein such an optimal circularity could previously only be realized in a tedious and time-consuming fashion by iteratively adapting the height of the grinding wheel 10, the height of the rest blade 40 and the height of the regulating wheel 20.

Figure 3:
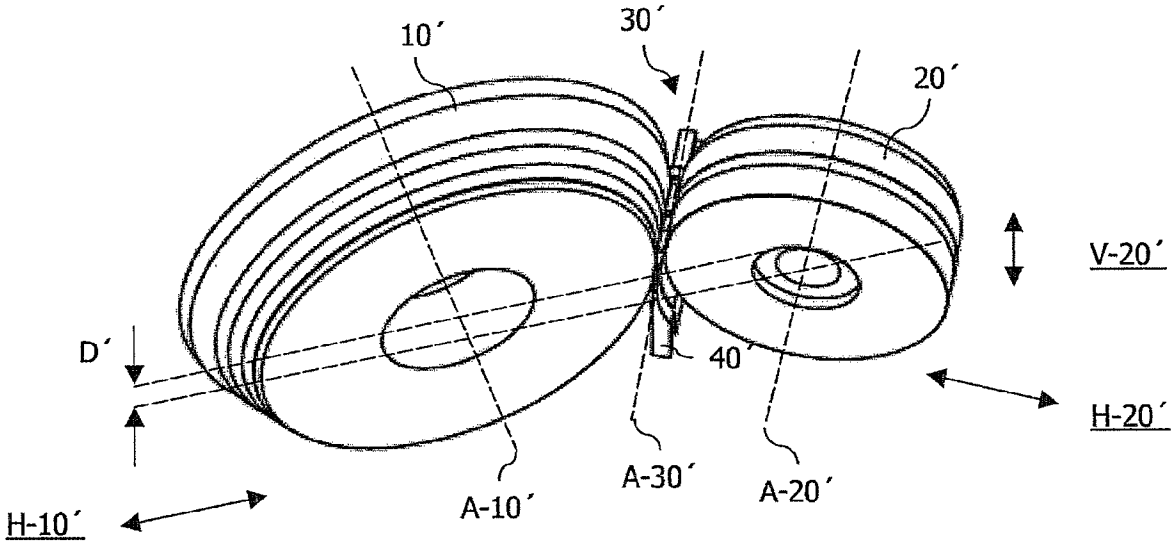
FIG. 3 shows a perspective top view of a second arrangement of a grinding wheel, a regulating wheel and a work piece for angular infeed grinding.

FIG. 3 shows a perspective top view of a second arrangement of a grinding wheel 10', a regulating wheel 20' and a work piece 30' for angular infeed grinding. This figure is also intended to once again elucidate the spatial aspects of the inventive arrangement. In this case, the grinding wheel and the regulating wheel 10' and 20' are displaced toward the work piece 30' at an angle between the directions H-10' and H-20'. Such an infeed is used, in particular, when a cylindrical seat of the work piece 30' should be ground together with its shoulder (s) in one production step. In this case, a migration of the work piece 30' from its optimal grinding position due to either the grinding wheel 10' and/or the regulating wheel 20' wearing down and/or the work piece 30' being ground down can lead to profile distortions on the shoulders of the work piece. Profile distortions are primarily caused by the shift of the grinding wheel 10' that leads to additional wearing-down after the grinding operation at the center height.

This can be prevented in a particularly simple fashion with the height adjustment of the rotational axis A-20' of the regulating wheel 20' beyond a plane P' in the directions V-20'. Since the rotational axes A-10' and A-30' of the grinding wheel 10' and the work piece 30' remain in the plane P', the grinding process can be easily controlled with the regulating wheel 20' only. This allows a particularly simple type of control, in which only one drive for the height adjustment or vertical displacement of the regulating wheel 20' is required. In this case, the control may be realized such that an optimal height adjustment D' of the regulating wheel 20' relative to the grinding wheel 10' and the work piece 30' is automatically realized and also readjusted when the diameters of the wheels 10', 20' and/or the work piece 30' change. For this purpose, a sensor system may be provided that respectively determines, e.g., the angle between a connection of the centers A-10' and A-20' and/or the centers A-30' and A-20' relative to the plane P'. In the figure, the rotational axis A-20' of the regulating wheel 20' is downwardly displaced relative to the plane P' by the height adjustment D'. Depending on the application, the rotational axis A-20' may also be upwardly displaced relative to the plane P' by the height adjustment D'. The corresponding values of optimal height adjustments D' can be stored in a storage unit that can be accessed by the control in order to correspondingly adjust the regulating wheel 20'. Consequently, the work piece 30' also can be quickly ground with high quality in a highly automated fashion by means of angular infeed grinding, namely with an equally simple and cost-efficient design of the corresponding grinding machine.

The invention claimed is:

1. A method for centerless grinding of a work piece between a grinding wheel and a regulating wheel, wherein the work piece is arranged between the wheels in such a way that a rotational axis of the work piece and a rotational axis of the grinding wheel lie in a common plane, wherein the grinding wheel and the regulating wheel can be laterally displaced toward the work piece, and wherein a height adjustment of the rotational axis of the regulating wheel across the common plane is varied in order to position the regulating wheel on the supported work piece.

2. The method according to claim 1, wherein optimal height adjustments of the rotational axis of the regulating wheel are stored and retrieved.

3. The method according to claim 1, in which a deviation of the rotational axis of the work piece from the common plane with the rotational axis of the grinding wheel is compensated by automatically adjusting the regulating wheel.

4. The method according to claim 1, wherein the at least one truing tool is guided in the common plane of the rotational axis of the grinding wheel and the rotational axis of the work piece.

5. An arrangement of a work piece for centerless grinding between a grinding wheel and a regulating wheel, wherein the work piece is held such that its rotational axis lies in a common plane with a rotational axis of the grinding wheel, wherein the grinding wheel and the regulating wheel can be laterally displaced toward the work piece, and wherein a height adjustment of the rotational axis of the regulating wheel from the first side to a second side of the common plane is kinematically decoupled from the lateral displacement of the regulating wheel and can be varied in order to position the regulating wheel on the supported work piece.

6. A centerless cylindrical grinding machine comprising an arrangement according to claim 5.

* * * * *